US008938812B1

(12) United States Patent
Gandy

(10) Patent No.: US 8,938,812 B1
(45) Date of Patent: Jan. 27, 2015

(54) DEODORANT STAIN PROTECTOR FOR CLOTHING

(71) Applicant: Gail M Gandy, Madison, AL (US)

(72) Inventor: Gail M Gandy, Madison, AL (US)

( * ) Notice: Subject to any disclaimer, the term of this patent is extended or adjusted under 35 U.S.C. 154(b) by 0 days.

(21) Appl. No.: 14/171,657

(22) Filed: Feb. 3, 2014

Related U.S. Application Data

(60) Provisional application No. 61/849,711, filed on Feb. 1, 2013.

(51) Int. Cl.
*A41D 27/12* (2006.01)
*A41D 27/13* (2006.01)

(52) U.S. Cl.
CPC ..... *A41D 27/13* (2013.01)
USPC ..... 2/55

(58) Field of Classification Search
CPC ..... A41D 27/04; A41D 27/12; A41D 27/13; A41D 27/136
USPC ..... 2/53, 55, 58, 59, 60, 170; 223/111
See application file for complete search history.

(56) References Cited

U.S. PATENT DOCUMENTS

| | | | | | |
|---|---|---|---|---|---|
| 24,033 | A | * | 5/1859 | Lesher | 450/30 |
| 169,515 | A | * | 11/1875 | Bragg | 2/55 |
| 223,621 | A | * | 1/1880 | Williams | 2/55 |
| 264,462 | A | * | 9/1882 | Kleinert | 2/56 |
| 345,970 | A | * | 7/1886 | Haskell | 2/55 |
| 360,564 | A | * | 4/1887 | Cory | 2/55 |
| 361,494 | A | * | 4/1887 | Dewey | 2/55 |
| 374,040 | A | * | 11/1887 | Campbell | 2/55 |
| 393,979 | A | * | 12/1888 | Heumann | 2/55 |
| 428,534 | A | * | 5/1890 | Sigsbee | 2/53 |
| 542,991 | A | * | 7/1895 | Crout | 2/55 |
| 567,285 | A | * | 9/1896 | Wormer | 2/55 |
| 569,599 | A | * | 10/1896 | Basch | 2/55 |
| 667,725 | A | * | 2/1901 | McClain | 2/55 |
| 715,743 | A | * | 12/1902 | Basch | 2/55 |
| 721,366 | A | * | 2/1903 | Guinzburg | 2/53 |
| 722,395 | A | * | 3/1903 | Basch | 2/55 |
| 780,421 | A | * | 1/1905 | Guinzburg | 2/55 |
| 795,562 | A | * | 7/1905 | Tatti | 252/190 |
| 811,924 | A | * | 2/1906 | Huebel | 2/53 |
| 815,186 | A | * | 3/1906 | Lockie | 2/55 |
| 887,454 | A | * | 5/1908 | Basch | 2/55 |
| 944,090 | A | * | 12/1909 | Grund | 2/55 |
| 1,108,427 | A | * | 8/1914 | Brennan | 2/53 |
| 1,122,113 | A | * | 12/1914 | Hausner | 2/55 |
| 1,137,452 | A | * | 4/1915 | Bienstock | 2/55 |
| 1,317,489 | A | * | 9/1919 | Graham | 2/55 |
| 1,317,490 | A | * | 9/1919 | Graham | 2/53 |
| 1,348,754 | A | * | 8/1920 | Shrader | 2/55 |
| 2,224,253 | A | * | 12/1940 | Clark | 2/56 |
| 2,573,346 | A | * | 10/1951 | Madsen | 2/55 |
| 2,636,175 | A | * | 4/1953 | Hoffman, Jr. | 2/55 |

(Continued)

*Primary Examiner* — Amber Anderson
(74) *Attorney, Agent, or Firm* — Mark Clodfelter

(57) ABSTRACT

A pair of protectors or shields for protecting an exterior of clothing from deodorant stains or smudges while getting dressed is disclosed. The shield is constructed of a material/materials that, when worn, cover and shield deodorant-covered areas of armpits of the user while the user is getting dressed. A strap is provided on each shield, the strap typically positioned on respective shoulders, and which hold the deodorant shields in place in the armpits. After the user finishes donning clothes and the clothes are in place, the deodorant shields are removed. Disposable and reusable deodorant shields are disclosed.

4 Claims, 8 Drawing Sheets

(56) References Cited

U.S. PATENT DOCUMENTS

| | | | | | |
|---|---|---|---|---|---|
| 2,637,032 | A * | 5/1953 | Pinsuti | 2/23 |
| 2,687,527 | A * | 8/1954 | Rendino | 2/55 |
| 2,808,589 | A * | 10/1957 | Tyroler | 2/54 |
| 4,084,586 | A * | 4/1978 | Hettick | 602/60 |
| 4,531,242 | A * | 7/1985 | Levine | 2/243.1 |
| 4,545,080 | A * | 10/1985 | Gorham | 2/54 |
| 4,832,010 | A * | 5/1989 | Lerman | 602/63 |
| 4,896,378 | A * | 1/1990 | Campana | 2/170 |
| 4,941,210 | A * | 7/1990 | Konucik | 2/171 |
| 5,168,577 | A * | 12/1992 | Detty | 2/16 |
| 5,245,707 | A * | 9/1993 | Green | 2/54 |
| 5,864,886 | A * | 2/1999 | Gregory et al. | 2/170 |
| 5,878,435 | A * | 3/1999 | Kast et al. | 2/16 |
| 5,901,379 | A * | 5/1999 | Hirata | 2/170 |
| 5,940,881 | A * | 8/1999 | Murphy | 2/16 |
| 6,138,276 | A * | 10/2000 | Asciutto et al. | 2/53 |
| 6,145,129 | A * | 11/2000 | Czekalla et al. | 2/53 |
| 6,178,557 | B1 * | 1/2001 | Bel Monte | 2/60 |
| 6,192,519 | B1 * | 2/2001 | Coalter | 2/16 |
| 6,418,561 | B1 * | 7/2002 | Gregory | 2/170 |
| 6,508,776 | B2 * | 1/2003 | Chiang et al. | 602/5 |
| 6,523,180 | B1 * | 2/2003 | Christopher | 2/59 |
| 6,726,641 | B2 * | 4/2004 | Chiang et al. | 602/5 |
| 6,813,779 | B1 * | 11/2004 | Williams | 2/16 |
| 7,090,651 | B2 * | 8/2006 | Chiang et al. | 602/5 |
| 7,200,872 | B2 * | 4/2007 | Gregory | 2/170 |
| 7,404,752 | B1 * | 7/2008 | Karon | 450/81 |
| 7,429,206 | B2 * | 9/2008 | Perry | 450/86 |
| 7,690,050 | B2 * | 4/2010 | Stockhamer | 2/69 |
| 2002/0165474 | A1 * | 11/2002 | Chiang et al. | 602/26 |
| 2002/0165475 | A1 * | 11/2002 | Chiang et al. | 602/26 |
| 2002/0184692 | A1 * | 12/2002 | Mullis | 2/16 |
| 2003/0114782 | A1 * | 6/2003 | Chiang et al. | 602/6 |
| 2003/0167550 | A1 * | 9/2003 | Andrews | 2/53 |
| 2006/0090239 | A1 * | 5/2006 | Koppen | 2/53 |
| 2007/0067888 | A1 * | 3/2007 | Manier | 2/53 |
| 2007/0174943 | A1 * | 8/2007 | Reeves | 2/53 |
| 2008/0141436 | A1 * | 6/2008 | Morgan | 2/170 |
| 2009/0276935 | A1 * | 11/2009 | Epps | 2/53 |
| 2012/0291175 | A1 * | 11/2012 | Lawrence | 2/53 |

* cited by examiner

DEODORANT STAIN PROTECTOR FOR CLOTHING

CROSS REFERENCE TO RELATED APPLICATIONS

This application claims the benefit of Applicant's provisional application No. 61/849,711, filed Feb. 1, 2013.

FIELD OF THE INVENTION

A pair of protectors or shields for protecting an exterior of clothing from deodorant stains or smudges while getting dressed is disclosed. The shield is constructed of a material/materials that, when worn, cover and shield deodorant-covered areas of armpits of the user while the user is getting dressed. A strap is provided on each shield, the strap typically positioned on respective shoulders, and which hold the deodorant shields in place in the armpits. After the user finishes donning clothes and the clothes are in place, the deodorant shields are removed. Disposable and reusable deodorant shields are disclosed.

This invention relates generally to protecting clothing from stains, and particularly to a pad that is temporarily worn over or in armpit areas while dressing in order to shield clothing from deodorant stains/marks/smudges while getting dressed, and which is removed after garments are in place. There are two types of garment deodorant stain protectors; a first type that is reusable and a second type that is disposable.

BACKGROUND OF THE INVENTION

Typically, after a bath or shower, or sometimes when changing clothes in preparation for going out, deodorant is applied to the armpit areas. As most deodorants are a liquid, gel or a soft opaque solid, the exterior of clothes are prone to be smudged or stained by deodorant when an individual is in the process of getting dressed. This is particularly true when the period of time between applying the deodorant and donning clothing is short, as the deodorant has not had time to dry or be absorbed, or excess deodorant has been applied. In addition, some clothing may be constructed such that various awkward positions are required in order to get into the clothes, which may allow deodorant-covered armpit areas to come into contact with anywhere on the exterior of the clothing, thus staining or smudging the exterior of the clothing. As such, there is a need for an armpit deodorant shield that can be easily positioned in deodorant-covered armpits to protect the exterior of clothes from becoming smudged or stained with deodorant while the person is getting dressed. After the clothing is donned, the armpit shields are removed.

DETAILED DESCRIPTION OF THE DRAWINGS

Figure 1:
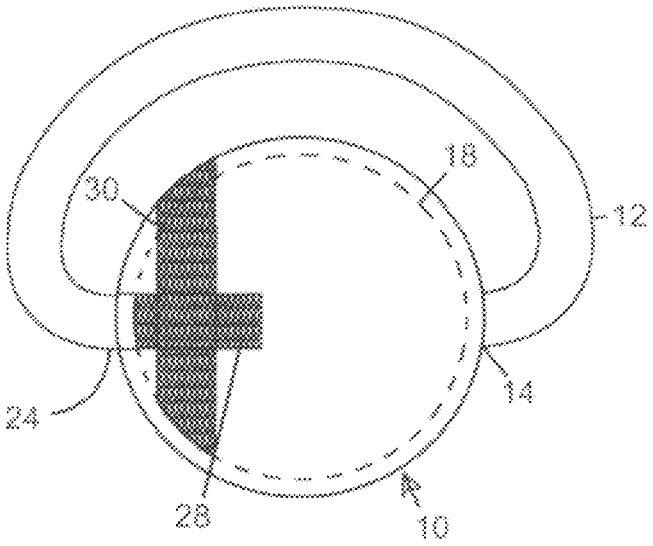
FIG. 1 is a front view of a round or circular embodiment of my deodorant shield showing a strap thereof in place.
Figure 1A:
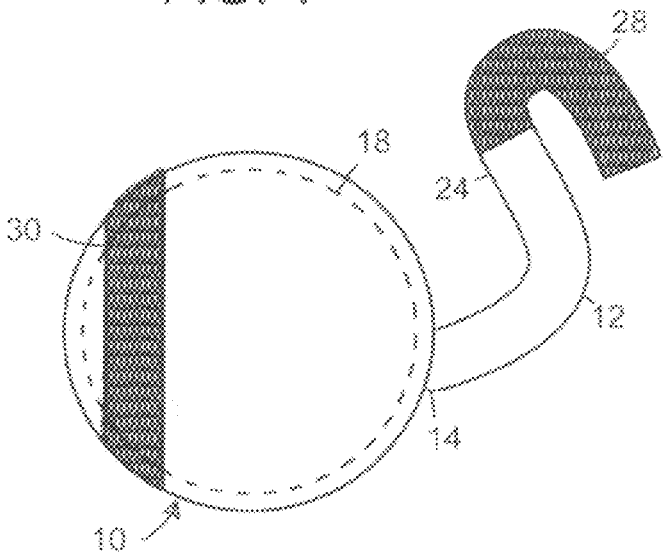
FIG. 1A is a front view of the embodiment of FIG. 1 showing the strap thereof detached at one end.

As shown in FIG. 1, my type non-disposable garment protector 10 may be a generally circular pad, with a strap 12, which may be an elastic strap, fixed in place at end 14, for example by sewing or bonding. Strap 12 may be from 8 inches to 16 inches long, and from about 0.5 inches to 2 inches wide. At the other end 24 of strap 12 is mounted a fastener, which as shown in FIGS. 1 and 1A, may be, for example, a loop part 28 of hook-and-loop tape. A corresponding hook portion 30 of the hook-and-loop tape is mounted to protector 10 opposite to where strap 12 is mounted, so that when loop portion 28 on end 24 of strap 12 is brought into contact with hook portion 30 on protector 10, strap 12 forms a continuous loop generally across protector 10. As shown in FIG. 1*a*, strap 12 may be detached at one end for removal from the armpit, as will be further explained.

Figure 1B:
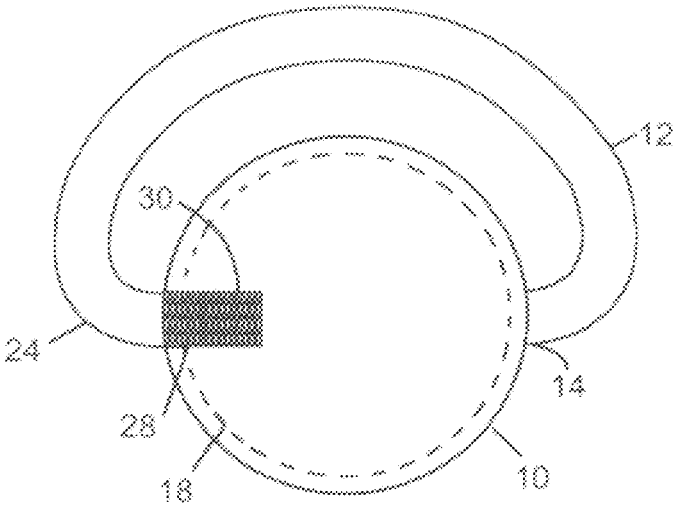
FIG. 1B is a front view of another embodiment of my deodorant shield showing hook-and-loop tape thereof in another orientation, with the strap attached thereto.
Figure 1C:
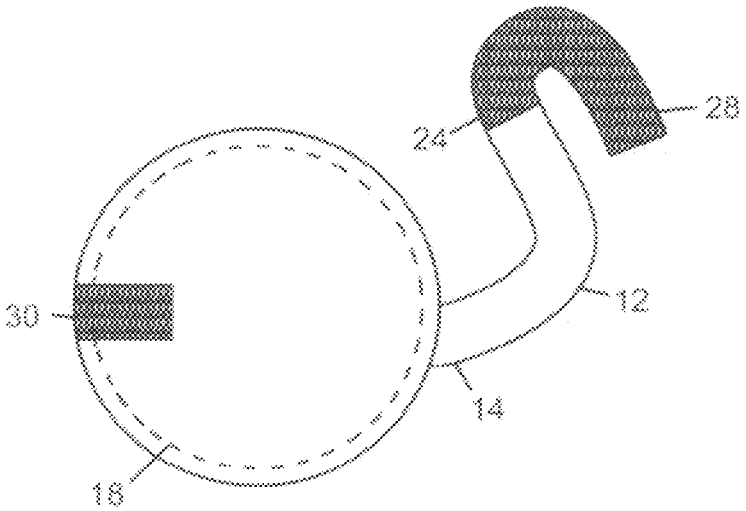
FIG. 1C is a front view of the embodiment of FIG. 1*b* showing the strap detached at one end.

Still referring to FIGS. 1 and 1*a*, it will be noted that hook portion 30 is mounted to protector 12 so that when strap 12 is brought across a middle of protector 10, loop portion 28 on strap 12 intersects perpendicularly with hook portion 30. This is so that strap 12 may be positioned at any angle as needed to accommodate differing anatomies for different people. Here; it has been found that end 24 of strap 12, when protector 10 is positioned in an armpit of smaller people, will be positioned generally centered on hook portion 30 and generally perpendicular thereto, as shown in FIG. 1. When used by a person with larger arms, end 24 of strap 12 will usually intersect hook portion 30 more toward one end or the other of hook portion 30, and at an angle other than generally perpendicular. While such a perpendicular arrangement is shown in FIGS. 1 and 1*a* for the hook portion, FIGS. 1*b* and 1*c* show the hook portion mounted on protector 10 so that the loop portion on the end of strap 12 intersects with the hook portion on protector 10 in a generally parallel manner. In other words, the hook portion in FIGS. 1B and 1C is mounted orthogonal to the mounting of the hook potion as shown in FIGS. 1 and 1A.

Figure 2:
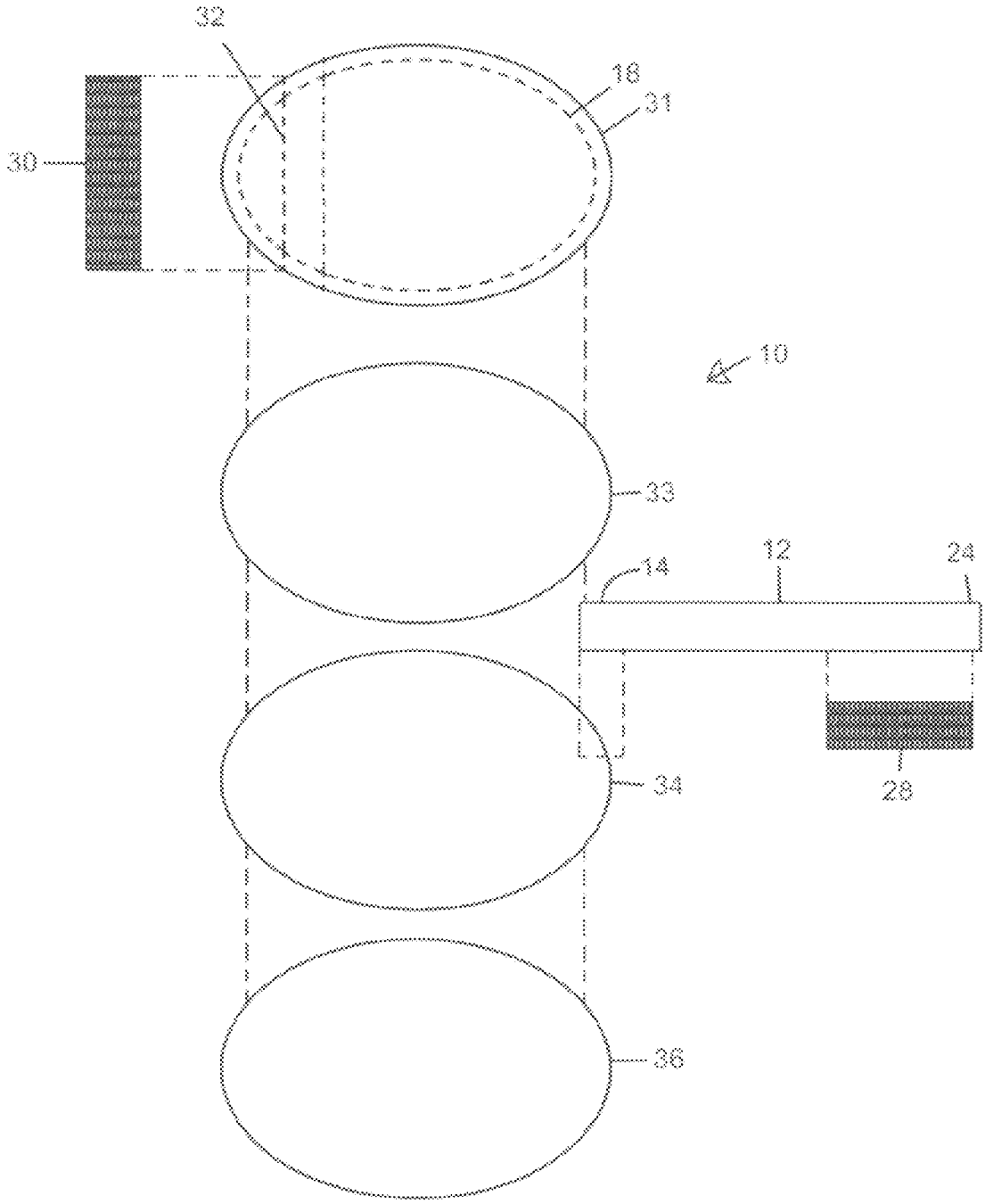
FIG. 2 is a diagrammatic view of construction details of an oval embodiment of my deodorant shield.

As shown in FIG. 2, and which may be applicable to at least some of the embodiments of a reusable protector of the instant invention, and possibly to some embodiments of a disposable protector, protector 10 is typically of between 6" to 8" in diameter, and constructed from a plurality of layers of material that are stitched together at 18 at least around a periphery thereof, and may be also stitched in more central regions to keep interior layers of material from bunching. In one embodiment, a top layer 31 and a bottom layer 36 form the outer surfaces of protector 10, and are selected from materials having durable, non-irritating properties, and which would generally absorb or otherwise shield clothing against deodorant stains. Some examples of such material are cotton, a cotton blend, flannel, jersey, cashmere, knit, fleece, mesh, polyester, satin, sateen, velvet, velour, soft canvas, denim, spandex, damask, georgette, nylon, mohair, twill, corduroy, chiffon, crepe, gabardine, wool, taffeta, felt, a flexible plastic sheet material, a flexible vinyl sheet material, lace, acrylic, tulle, cheesecloth, silk or any other suitable material, and in any combination. Layers 33 and 34 are sandwiched between layers 31 and 36, and serve to stiffen protector 10 to an extent that it will not buckle or fold of its own accord when in use, but yet is sufficiently flexible to allow bending during use when in place in an armpit. Materials of layers 33 and 34 may be, by way of example only, iron on and non iron on interfacing, quilt batting, cottons, synthetic cotton, wool, polyester, foam, cotton blends, plastic, rubber, foam, and felt. In other embodiments, both layers 33 and 34 may be one or a combination of the aforementioned materials. With this construction, and as noted, protector 10 is relatively stiff so as to not buckle, fold or fall away under its own weight from deodorant-covered regions of a person's armpits, but yet sufficiently flexible to accommodate contours of a person's armpit while a person is moving their arm about in the process of donning clothing.

Strap 12 may be constructed of elastic, rubber band material or other synthetic stretchable material, or ribbon, a flexible plastic material, or a string or cord. Strap 12 is attached to protector 10 at end 14, typically by inserting end 14 between the layers 33 and 34, or at least between layers 31 and 36 on one side or edge of protector 10, and stitching or bonding end 14 in place between respective layers of protector 10. In another way of constructing the protector, the layers are stitched together substantially around a periphery of the protector, but leaving a slot through which the end of strap 12 may be inserted, and then stitched or bonded. Of course, where the protector is constructed of a relatively heavy single layer of material, strap 12 may be merely stitched or bonded to one side of the protector. At an opposite end 28 of strap 12 is mounted the loop portion 28 of hook-and-loop tape. On or near an opposite edge of the protector with respect to where strap 12 is permanently attached is mounted the hook portion 30 of hook-and-loop tape, as by stitching 32, or bonding. When completed, protector 10 appears as in FIGS. 1-1A where the loop portion 28 of hook-and-loop tape on the strap attaches to the hook portion 30 on the protector in generally perpendicular relation, while FIGS. 1B and 10 show the loop portion 28 on the strap end attaching to the hook portion in generally parallel relation.

Figure 3A:
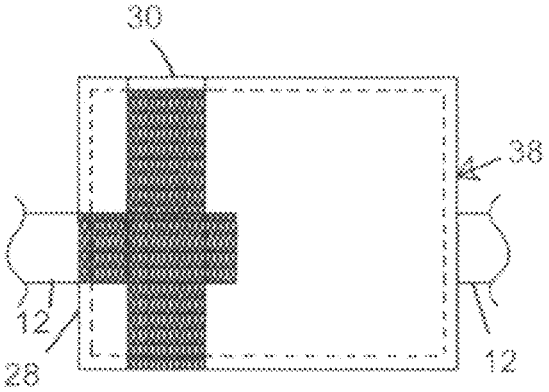
FIG. 3A is an illustration of a square embodiment of my deodorant shield.
Figure 3B:
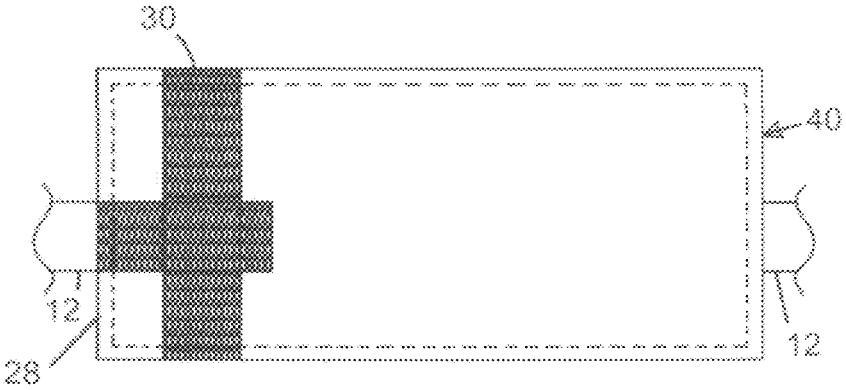
FIG. 3B is an illustration of a rectangular embodiment of my deodorant shield.
Figure 3C:
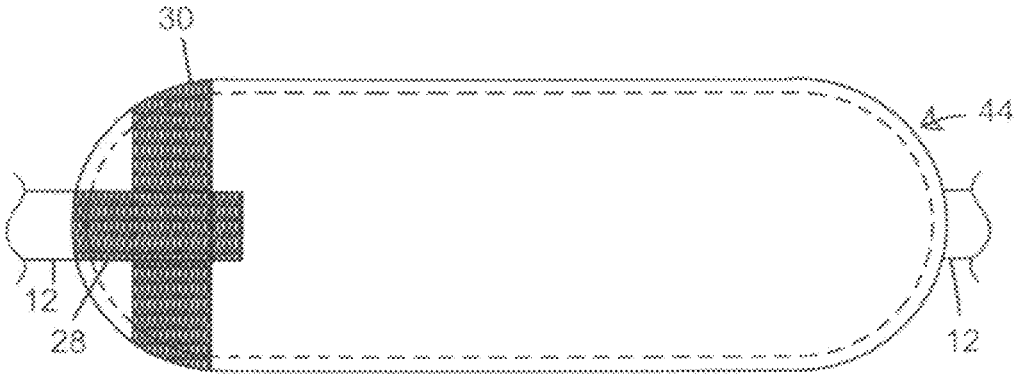
FIG. 3C is an illustration of an elongated embodiment of my new deodorant shield having rounded ends.

FIGS. 3A-3C illustrate embodiments of a square protector 38, a rectangular protector 40 and a generally oval protector 44. These embodiments may be constructed as described above for FIG. 2A, with hook portion 30 mounted at one side or end of a respective protector generally perpendicular to strap 12 emerging from the protector on the opposite side. As noted, this allows loop portion 28 of the hook-and-loop tape to intersect with the respective hook portion perpendicularly or at any angle as needed by the user.

Figure 4A:
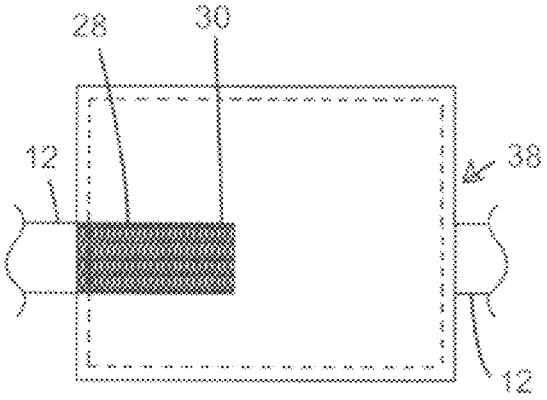
FIGS. 4A-4C are illustrations of the embodiments of FIGS. 3A-3C showing a different orientation of hook-and-loop tape used to attach a strap thereof.
Figure 4B:
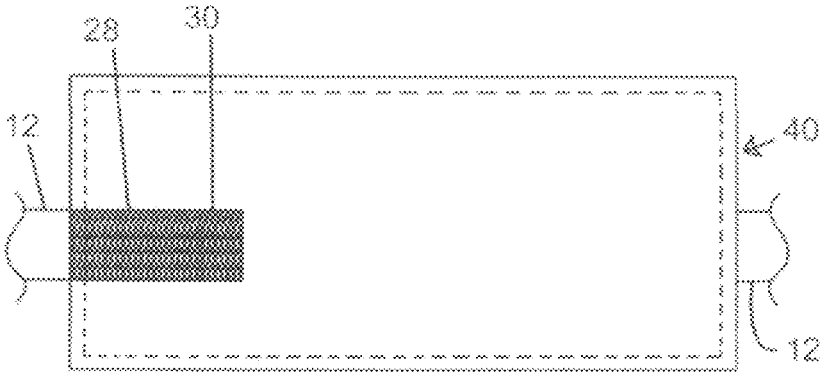
Figure 4C:
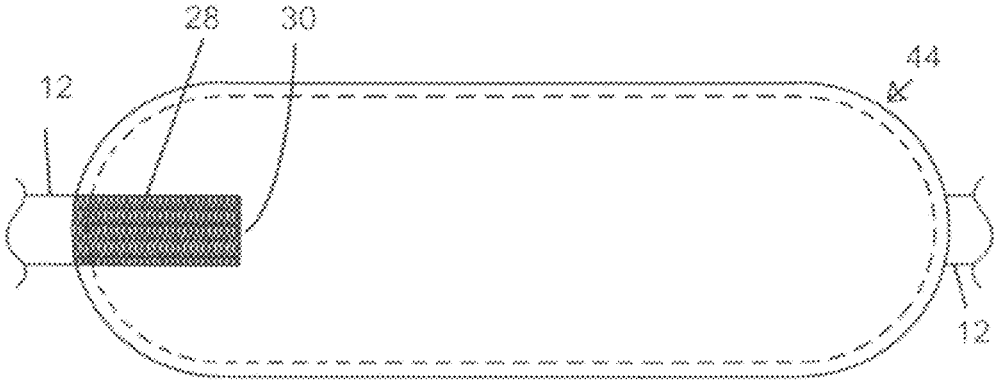
Figure 5A:
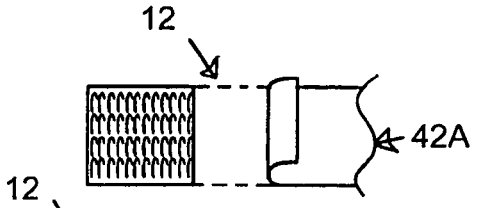
FIGS. 5A-5I are illustrations of different attachment mechanisms to attach the strap to the deodorant shield.
Figure 5B:
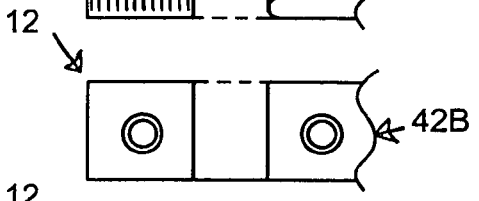
Figure 5C:
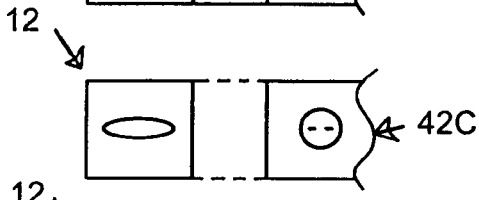
Figure 5D:
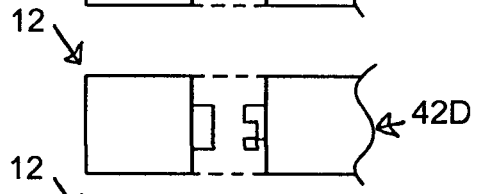
Figure 5E:
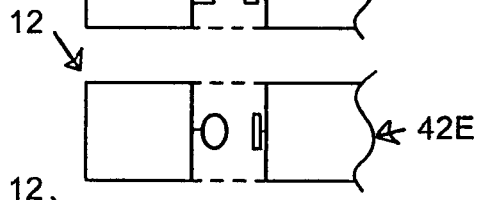
Figure 5F:
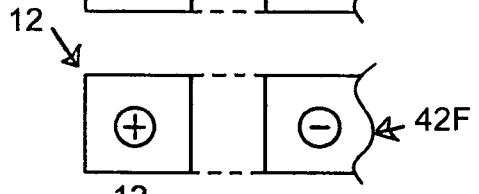
Figure 5G:
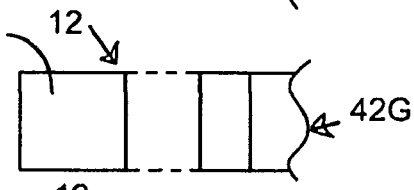
Figure 5H:
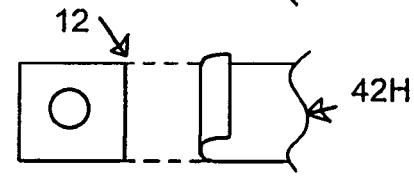
Figure 5I:
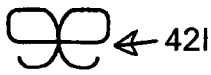

FIGS. 4A-4C illustrate embodiments of a protector 38, 40 and 44 similar to the embodiments of FIGS. 3A-3C, except hook portion 30 is mounted parallel or along the same axis as strap 12 emerging from the opposite side or end of a respective protector.

FIGS. 5A-5I illustrate embodiments of closures that may be used to temporarily attach the loose end of strap 12 to the protector. The different types of closures for a reusable garment protector are FIG. 5A, hook-and-loop tape 42A as described above, FIG. 5B, a snap 42B, FIG. 5C, a button and eye 42C, FIG. 5D, a hook and eye 42D, FIG. 5E, a T-hook 42E, FIG. 5F, a magnet 42F FIG. 5G, tape 42G with a glue region G on one of the strap or a patch P on the protector, FIG. 5*h*, adhesive dots 42H on strap 12 and the protector, and FIG. 5I, a simple string tie 42I.

Figure 6A:
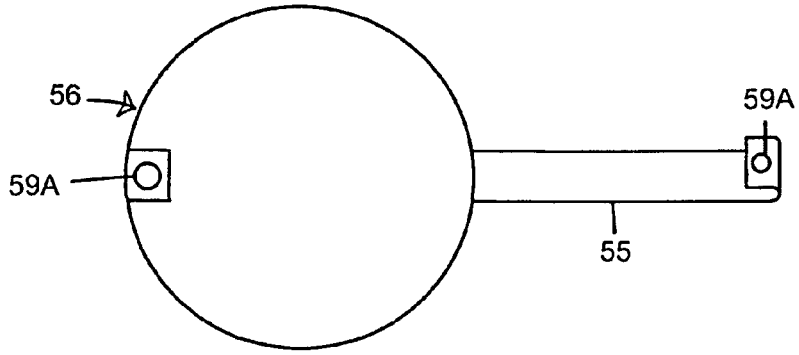
FIGS. 6A-6D are different configurations of a disposable deodorant shield.
Figure 6B:
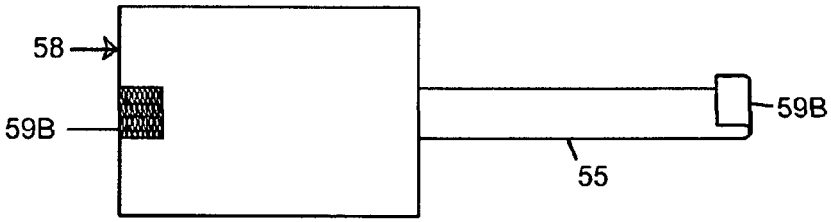
Figure 6C:
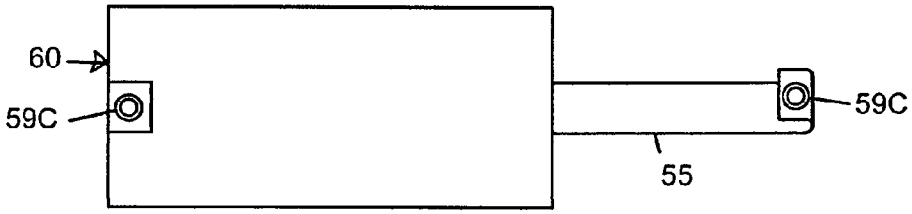
Figure 6D:
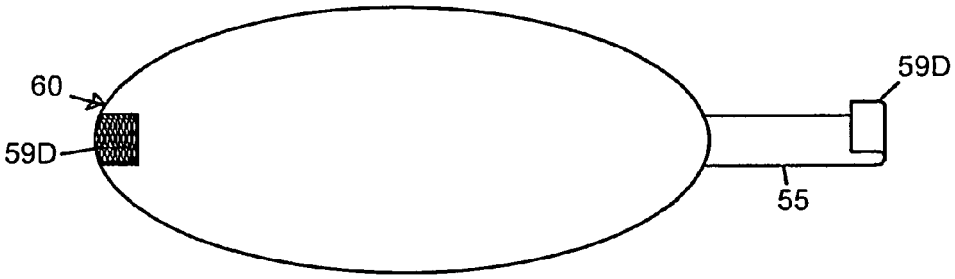

This invention also contemplates a disposable protector, which may be used once or perhaps only a few times and then discarded. This embodiment may be constructed of a paper material, which may be waterproof, such as or similar to material from which disposable hospital gowns worn by medical patients are fabricated, spun-bonded materials such as Kevlar™, or any other materials suitable for disposable use, such as sheet plastic, sheet vinyl, and sheet rubber. In some embodiments, the disposable protector may be constructed of multiple layers, as shown in FIG. 2 in order to provide some stiffness to the protector and provide an adequate barrier for protecting clothing against deodorant. A strap for a disposable embodiment may be constructed of elastic banding, rubber band, or any ribbon material. In these embodiments, clothing stores may provide a disposable protector dispenser for people to obtain clothing protectors from when trying on clothing. In other uses, disposable protectors may be purchased by consumers as an alternative to a permanent protector. FIGS. 6A-6D show different practical shapes for such a disposable protector. Such shapes for disposable garment protectors may be a round protector 56 (FIG. 6A), a square protector 58 (FIG. 6B), a rectangular protector 60 (FIG. 6C), and an oval protector 62 (FIG. 6D). Different embodiments of fasteners for a disposable garment protector may be adhesive dots 59A, double sided tape 59B, re-positionable tape 59C, snaps 59D and hook and loop tape 59E.

Figure 7A:
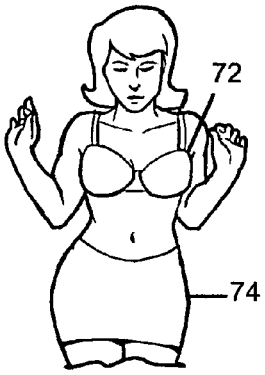
FIGS. 7A-7F show consecutive steps in using my deodorant shield.
Figure 7B:
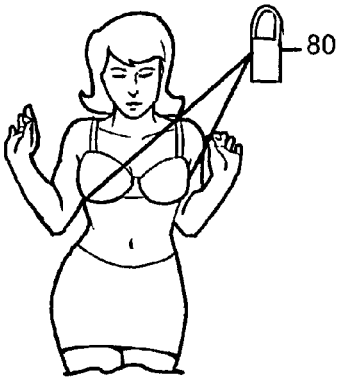
Figure 7C:
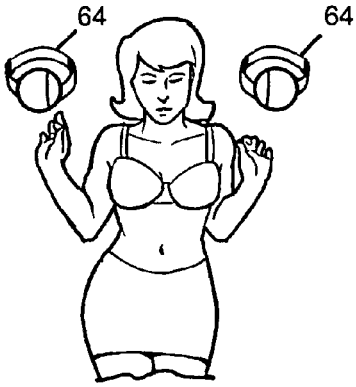
Figure 7D:
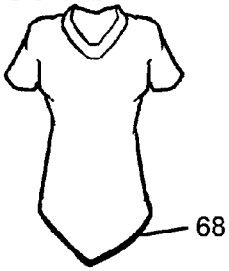
Figure 7D:
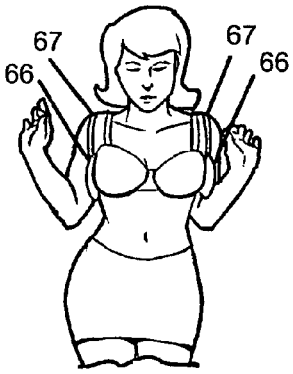
Figure 7E:
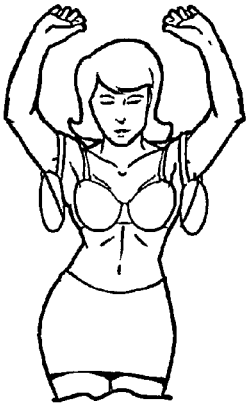
Figure 7F:
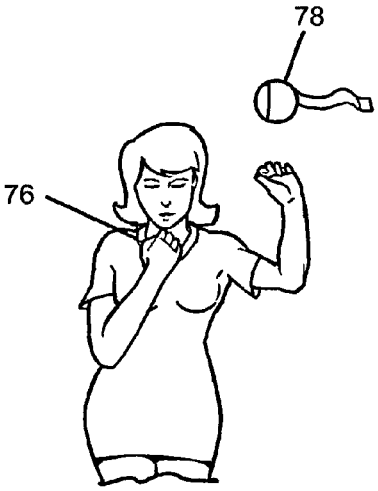

To use my garment protector, any undergarments, such as a bra 72, may be donned (FIG. 7A), after which a deodorant product 80 may be applied to the armpits (FIG. 7*b*). The protectors 64 (FIG. 7C) may then be positioned in the armpits over the area where the deodorant product was applied, covering and preventing such areas from coming into contact with clothing while it is being donned. Here, the user would typically fasten strap 12 to the protector in a predetermined location that is comfortable, and then position the closed garment protectors in their armpits by putting their hands through the elastic loops formed by strap 12, and then sliding the garment protectors up the arms and into the person's armpit to cover all regions to which deodorant has been applied. For convenience, the closure is positioned to the front where a user can reach either through the neckline or up under the garment to release the closure. The elastic straps 12 are typically positioned on the top of the shoulder 67 of the user, and where hook-and-loop tape is used, the strap may be adjusted as needed. Here, where the user is a smaller person, the loose end of strap 12 will intersect the protector generally as shown in FIG. 1, and where the user is a larger person, strap 12 may intersect the protector at a more angular relation and perhaps to one end or the other of hook portion 30. After a protector is in place in each respective armpit (FIG. 7D), garment or garments 68 are donned (FIG. 7E). Protectors 78 may then be removed (FIG. 7F). In this manner, the possibility of contacting an exterior of clothing with deodorant from an armpit, and thus smearing or soiling the exterior of the garment or clothing with deodorant is prevented.

While specific embodiments are disclosed herein, it should be apparent that other embodiments are also viable. For instance, a reusable pad may be constructed of a single, heavy layer of material of any of the disclosed shapes and sizes, with a single elastic strap and fastener. Here, the weight of the material is selected so that the protector is capable of generally conforming to an armpit, but not so light that it falls away from portions of an armpit under its own weight, exposing areas of the armpit covered with deodorant to clothing before the clothing is fully donned. Likewise, the weight of each layer of fabric for a reusable protector is such that the combined weighs of the layers together form a protector of a sufficient weight that it conforms to an armpit, but does not fall away and expose deodorant to clothing. In a similar manner, a disposable protector may be of a relatively heavy weight of material, or conformed, as by many small corrugations, folds or the like oriented in perpendicular directions, so that a disposable protector is sufficiently stiff that it does not fall away and expose areas of the armpit covered with deodorant to clothing while the clothing is being donned.

Having thus described my invention and the manner of its use, it should be apparent that modifications may be made thereto that fall within the scope of the following appended claims, wherein I claim:

The invention claimed is:

1. A method for protecting an exterior of clothing from deodorant stains and smears that may occur when donning such clothing comprising:

constructing a pair of deodorant shields of a size sufficient to cover each armpit area where deodorant is applied, wherein said pair of deodorant shields each comprise a strap, each strap having a first fixed end and a second end attached to the shield with a closure, covering armpit areas with said deodorant shields, donning clothing while said deodorant shields cover the armpit areas where deodorant is applied, after said clothing is donned, reaching through an opening in the clothing to release the closures of the straps to remove the shields while the clothing is worn.

2. The method of claim 1 said straps fit over a shoulder to hold said deodorant shield in place in an armpit.

3. The method of claim 2 wherein said constructing a pair of deodorant shields further comprises constructing each said deodorant shield to be sufficiently stiff to prevent said deodorant shield from bending or folding under the deodorant shields' own weight, but be sufficiently flexible to be bent or folded.

4. The method of claim 2 wherein said constructing a pair of deodorant shields of a size sufficient to cover each armpit area further comprises constructing said pair of deodorant shields to be about 6 inches to 8 inches in diameter.

* * * * *